US006988021B2

(12) United States Patent
Daniels, Jr. et al.

(10) Patent No.: US 6,988,021 B2
(45) Date of Patent: Jan. 17, 2006

(54) METHOD OF ADDRESSING AND SORTING AN INTEROFFICE DISTRIBUTION USING AN INCOMING MAIL SORTING APPARATUS

(75) Inventors: Edward P. Daniels, Jr., Trumbull, CT (US); Joseph D. Mallozzi, Trumbull, CT (US)

(73) Assignee: Pitney Bowes Inc., Stamford, CT (US)

( * ) Notice: Subject to any disclaimer, the term of this patent is extended or adjusted under 35 U.S.C. 154(b) by 632 days.

(21) Appl. No.: 10/026,580

(22) Filed: Dec. 19, 2001

(65) Prior Publication Data

US 2003/0111392 A1 Jun. 19, 2003

(51) Int. Cl.
*G06F 7/00* (2006.01)

(52) U.S. Cl. ..... 700/224; 700/221; 700/223; 700/225; 700/226; 209/583; 209/584; 209/900

(58) Field of Classification Search ..... 700/219–227; 270/58.06, 39.04, 58.31; 209/583, 584, 900; 705/406, 408, 410

See application file for complete search history.

(56) References Cited

U.S. PATENT DOCUMENTS 4,800,506 A * 1/1989 Axelrod et al. ..... 700/227
5,703,783 A * 12/1997 Allen et al. ..... 700/213
5,832,504 A * 11/1998 Tripathi et al. ..... 715/526
5,971,391 A 10/1999 Salomon et al. ..... 271/153
6,003,857 A 12/1999 Salomon et al. ..... 271/122
6,003,902 A * 12/1999 Petkovsek ..... 283/61
6,135,441 A 10/2000 Belec et al. ..... 271/35
6,156,988 A * 12/2000 Baker ..... 209/584
6,217,020 B1 4/2001 Supron et al. ..... 271/149
6,292,709 B1 * 9/2001 Uhl et al. ..... 700/226
6,328,300 B1 12/2001 Stefan et al. ..... 271/2
6,457,012 B1 * 9/2002 Jatkowski ..... 707/101
6,557,755 B1 * 5/2003 Pickering et al. ..... 235/376

* cited by examiner

*Primary Examiner*—Donald P. Walsh
*Assistant Examiner*—Jeffrey Shapiro
(74) *Attorney, Agent, or Firm*—Michael J. Cummings; Charles R. Malandra, Jr.; Angelo N. Chaclas

(57) ABSTRACT

The present invention is directed, in a general aspect, system including a mail sorting apparatus which generally comprises a feeder, a line scan camera, an in-line printer, a control system which may be the microprocessor based personal computer system, at least one addressee database and sort plan, a mailpiece transporter, a bin module with compartments or sort bins for receiving mailpieces. This invention overcomes the disadvantages of the prior art by enabling a mail sorting apparatus to address sort internal mailings (business to employee mail). The foregoing is accomplished by addressing and sorting employee mailpieces in one process by using information from one or more databases of the mail sorting apparatus, including the addressee database and sort plan, and an in-line printer for printing employee and/or delivery information on the employee mailpiece. Thus, the method of the present invention provides a less costly, simplified way to prepare internal mailings.

11 Claims, 6 Drawing Sheets

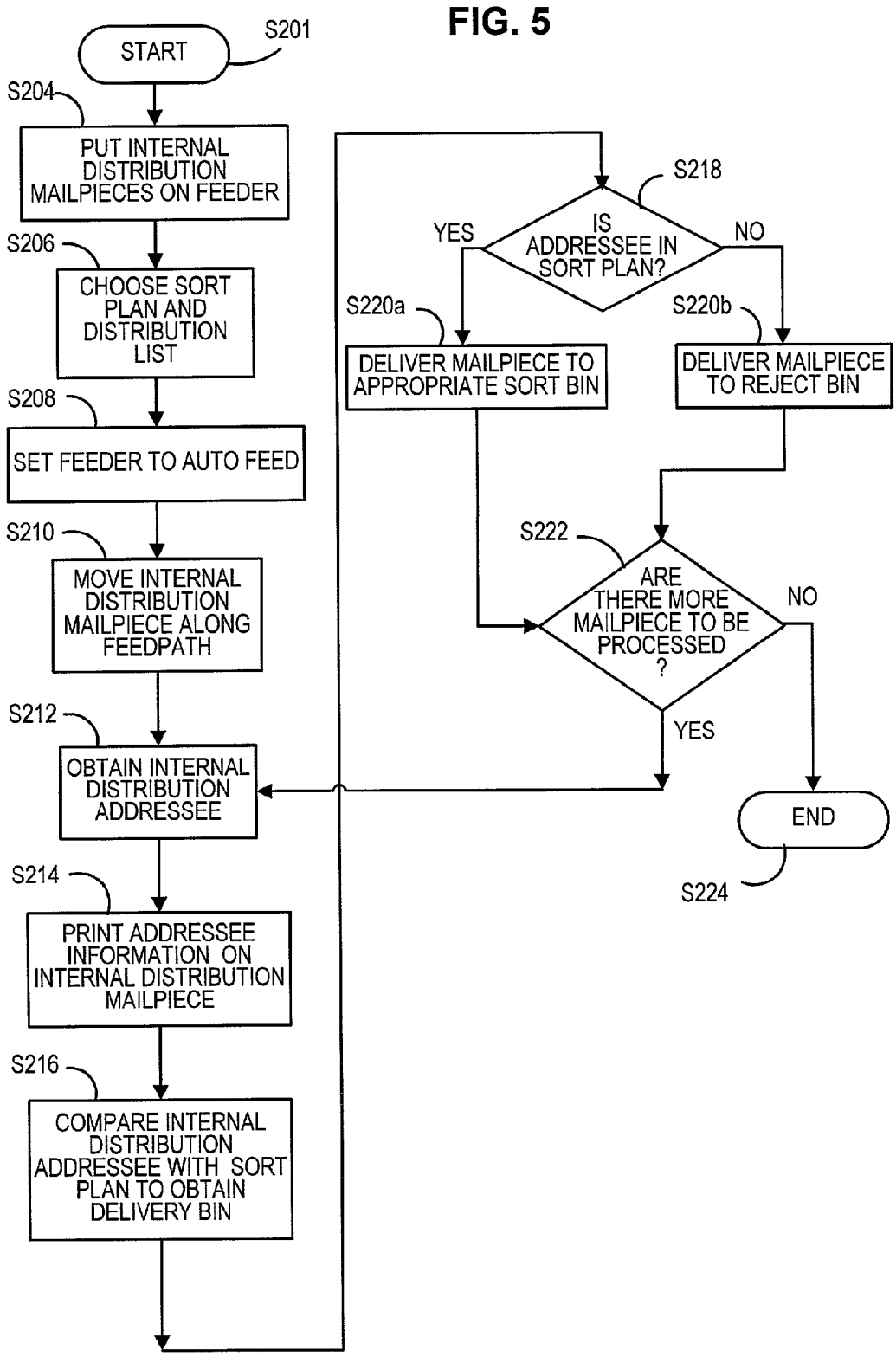
FIG. 5
START
S201
S204
PUT INTERNAL DISTRIBUTION MAILPIECES ON FEEDER
S206
CHOOSE SORT PLAN AND DISTRIBUTION LIST
S208
SET FEEDER TO AUTO FEED
S210
MOVE INTERNAL DISTRIBUTION MAILPIECE ALONG FEEDPATH
S212
OBTAIN INTERNAL DISTRIBUTION ADDRESSEE
S214
PRINT ADDRESSEE INFORMATION ON INTERNAL DISTRIBUTION MAILPIECE
S216
COMPARE INTERNAL DISTRIBUTION ADDRESSEE WITH SORT PLAN TO OBTAIN DELIVERY BIN
S218
IS ADDRESSEE IN SORT PLAN?
YES
NO
S220a
DELIVER MAILPIECE TO APPROPRIATE SORT BIN
S220b
DELIVER MAILPIECE TO REJECT BIN
S222
ARE THERE MORE MAILPIECE TO BE PROCESSED ?
NO
YES
END
S224

METHOD OF ADDRESSING AND SORTING AN INTEROFFICE DISTRIBUTION USING AN INCOMING MAIL SORTING APPARATUS

FIELD OF THE INVENTION

The invention disclosed herein relates generally to automated mail sorting and more particularly, to addressee databases and a method of using an incoming mail sorting apparatus to address and sort internal mailings.

BACKGROUND

The processing and handling of mailpieces consumes an enormous amount of human and financial resources, particularly if the processing of the mailpieces is done manually. The processing and handling of mailpieces not only takes place at the Postal Service, but also occurs at each and every business or other site where communication via the mail delivery system is utilized. That is, various pieces of mail generated by a plurality of departments and individuals within a company need to be addressed, collected, sorted and franked as part of the outgoing mail process. Additionally, incoming mail needs to be collected and sorted efficiently to ensure that it gets to the addressee in a minimal amount of time. Since much of the documentation and information being conveyed through the mail system is critical in nature relative to the success of a business, it is imperative that the processing and handling of the mailpieces be done efficiently and reliably so as not to negatively impact the functioning of the business.

In view of the above, various automated mail handling machines have been developed for processing mail (removing individual pieces of mail from a stack and performing subsequent actions on each individual piece of mail). Individual mailpieces are separated from a stack, read using an optical character recognition system (OCR) and compared to an addressee database in order to determine the appropriate destination points for delivery of the mailpieces. The addressee database can contain hundreds or even thousands of individual addressee names, such as names of employees of a company for which incoming mailpieces are being sorted for delivery. In addition to incoming mail, the mailpiece sorting apparatus can also handle interoffice mailpieces which are pre-addressed and then sorted using the incoming mailpiece sorting apparatus and performing a process much like that of sorting incoming mailpieces, i.e. reading the addressee, determining the destination and delivering the mailpiece to the appropriate sort bin.

For interoffice mailpieces, this process is duplicative in that the company is printing the addressees for each interoffice mailpiece from a database separate from the mailpiece sorting apparatus and with printing equipment separate from the incoming mailpiece sorting apparatus.

Thus, one of the problems of the prior art is that it does not provide stream lined preparation of internal mailings. Another problem of the prior art is that it is time consuming and costly. Another problem of the prior art is that it is dependent upon multiple databases and/or requires updating of addressee information at several databases within a company. Therefore, a system and method that allow for easy addressing and sorting of internal/business to employee mailings is needed.

SUMMARY OF THE INVENTION

This invention overcomes the disadvantages of the prior art by enabling a mail sorting apparatus to address sort internal or interoffice mailings (business to employee mail).

The Pitney Bowes B2E Inline Addressing™ System provides an inline solution where the capability of addressing and sorting internal/.business to employee mailings is built into a mailpiece sorting apparatus. The foregoing is accomplished by providing a mail sorting apparatus which generally comprises a feeder, a line scan camera, an in-line printer, a control system which may be the microprocessor based personal computer system, at least one addressee database and sort plan, a mailpiece transporter, a bin module with compartments or sort bins for receiving mailpieces. By the present invention, the mailpiece sorting apparatus is used to create business to employee mailings.

The present invention is also direct to in a general aspect a method of creating and sorting an employee mailing using the mailpiece sorting apparatus and at least one database containing addressee information and sort plan information. The in-line printer prints employee information on the mailpiece. The sorting apparatus delivers the mailpieces to sort bins designated by the sort plan.

The present invention provides a simple method for preparing an internal mailing. Mailpieces can be addressed and sorted in one process. Thus, the method of the present invention provides a less costly, simplified way to prepare internal mailings. Other advantages of the invention will in part be obvious and will in part be apparent from the specification. The aforementioned advantages are illustrative of the advantages of the various embodiments of the present invention.

BRIEF DESCRIPTION OF THE DRAWINGS

FIG. 5 is a flowchart of an embodiment of the method of the present invention illustrating steps of creating and sorting an employee mailing.

DETAILED DESCRIPTION OF THE PRESENT INVENTION

Figure 1:
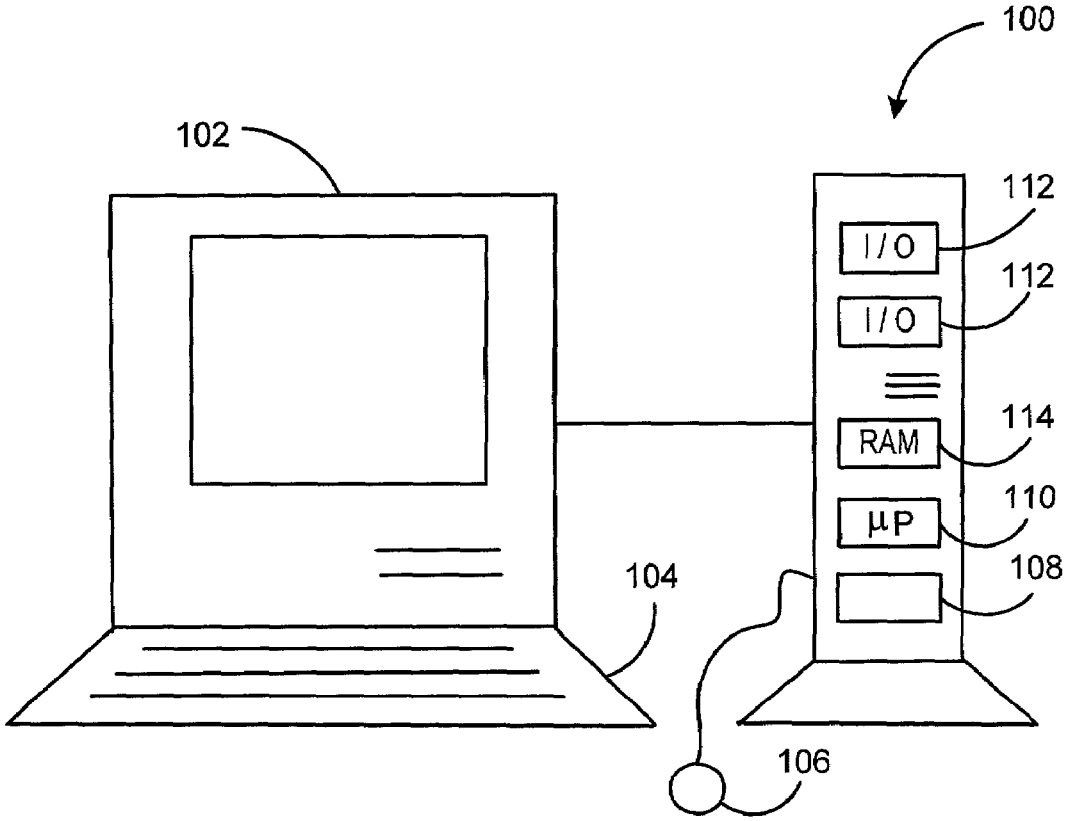
FIG. 1 is a block diagram that illustrates a computer system with which an embodiment of the invention may be implemented.

In describing the present invention, reference will be made herein to FIGS. 1–6 of the drawings in which like numerals refer to like features of the invention. Features of the invention are not necessarily shown to scale in the drawings.

Control and Mail Sorting Apparatus Overview

FIG. 1 is a block diagram that illustrates a computer system 100, the use of which an embodiment of the invention may be implemented. Computer system 100 may be a personal computer which is used generically and refers to present and future microprocessing systems with at least one processor operatively coupled to user interface means, such as a monitor 102 and keyboard 104, and/or a cursor control, such as a mouse or a trackball 106, and storage media 108. The personal computer 100 may be a workstation that is accessible by more than one user. The personal computer also includes a conventional processor 110, such as a Pentium® microprocessor manufactured by Intel, and conventional memory devices such as hard drive 108, floppy or CDRW drive(s) 112, and memory 114.

Figure 2A:
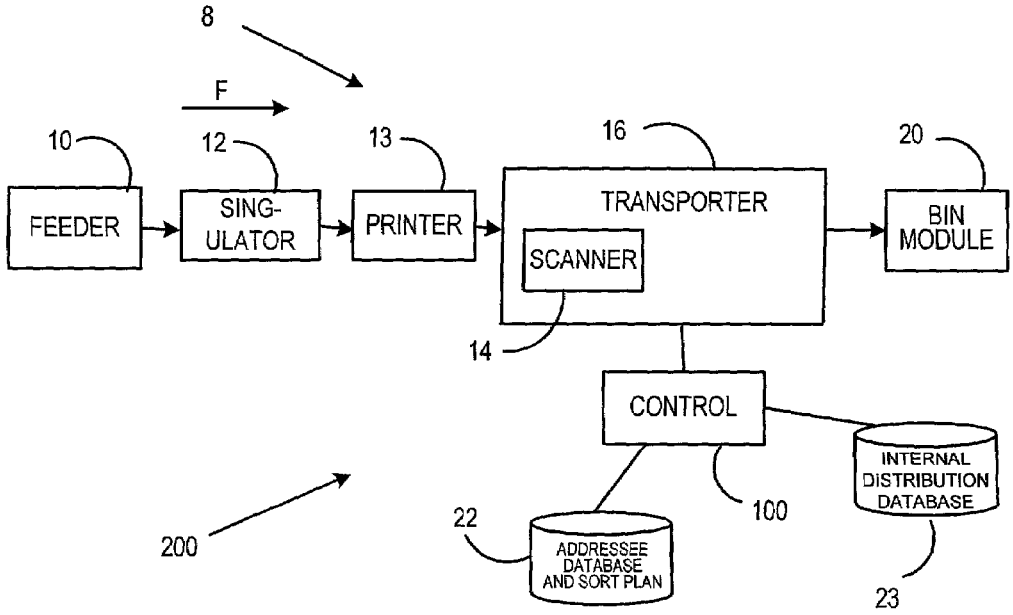
FIG. 2*a* illustrates the connection of the computer system to a sorting apparatus.
Figure 2B:
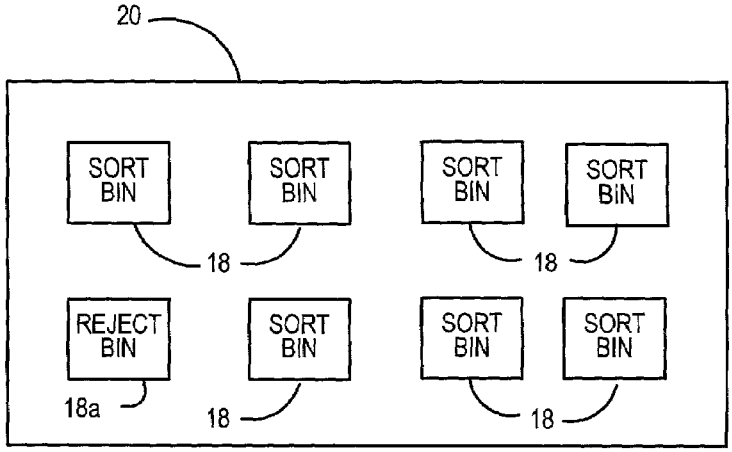
FIG. 2*b* is a block diagram illustrating an eight bin module which may be part of the mailpiece sorting apparatus which is used to perform an embodiment of the of the present invention.

The computer system 100 can be connected to a sorting apparatus 8 as illustrated in FIG. 2*a*. The system 200 of the present invention generally comprises a mailpiece sorting apparatus 8 configured to work with internal mailing data. The mailpiece sorting apparatus 8 may generally comprise a feeder 10, a line scan camera 14 (and optical character recognition (OCR) software, not shown), a mailpiece transporter 16, a bin module 20 (shown in FIG. 2*b*) with compartments or bins 18 (sort bin) and 18*a* (OCR reject bin), for receiving sorted mailpieces 30 (other bins may be designated as needed, such as, for example outgoing mail bin) and a control system 100 which may be the microprocessor based personal computer system described above. The computer system 100 includes appropriate memory devices 108, 114 for storage of information such as an address database and sort plan 22 and an internal distribution database (or alternately a single database with addressee information and sort plan or other suitable configuration). One of ordinary skill in the art would be familiar with the general components of the sorting apparatus with which the system and method of the present invention may be implemented.

The mailpiece sorting apparatus 8 and the OCR software may be used to determine the addressee of incoming mailpieces or other information such as return to sender graphics (not shown) printed on the face of mailpieces. The reading of various information may be performed with the assistance of intelligent character recognition (ICR) or imaging and optical character recognition (OCR/IC) which may be part of the above mentioned OCR software and can read the various fields on the mailpiece 30. In the present invention the mailpiece sorting apparatus 8 is used to create business to employee mailings.

The system 200 of the present invention can also be configured to track and report internal mailings information. It could also be configured to create personalization of internal communications i.e. the printer could print an icon, message or clip art along with the employee name and/or address. The tracking and reporting of internal mailings information can be used for charge back and accounting for the mail sorting/internal mailings preparation.

Internal Addressee/Interoffice Mailpieces

Figure 3A:
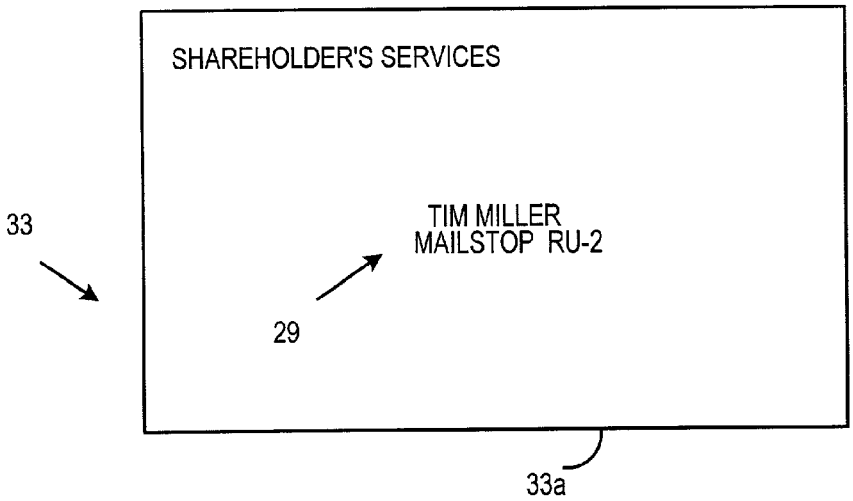
FIGS. 3*a–b* are front and back view of an exemplary mailpiece from internal mailing addressed and sorted by the system and method of the present invention.
Figure 3B:
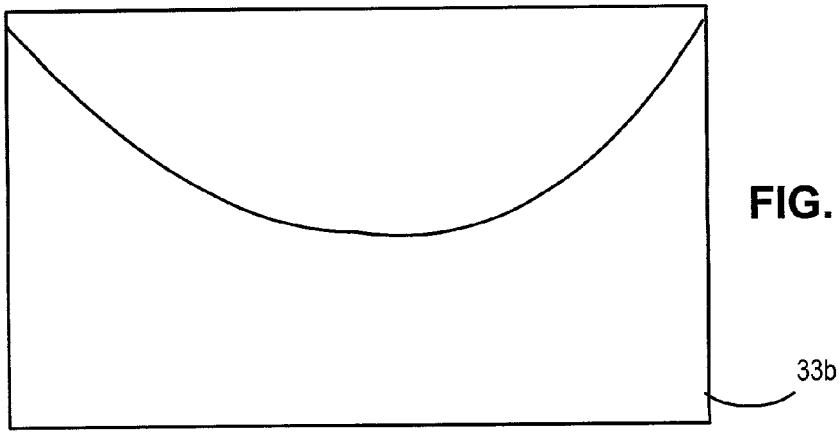
Figure 3C:
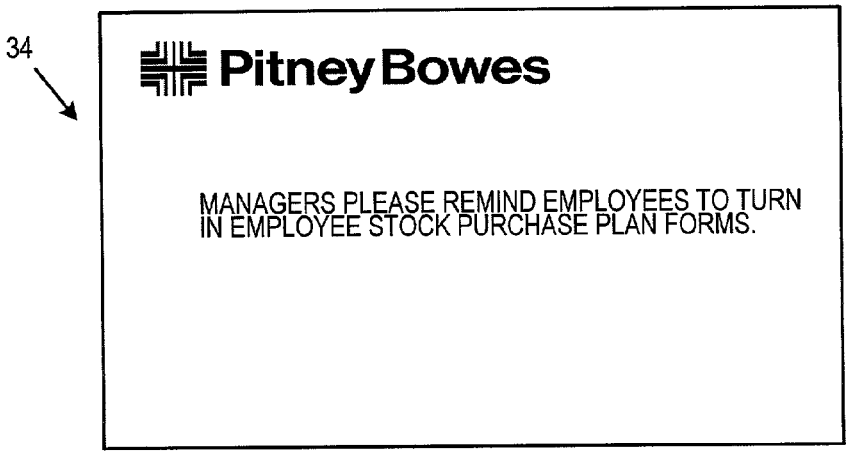
FIG. 3*c* illustrates a letter that is put inside of the mailpiece.

FIGS. 3*a–b* illustrate an exemplary interoffice mailpiece 33, which is an envelope. FIG. 3*a* illustrates the front side of the exemplary mailpiece with employee address printed thereon. The employee address 29 is printed using the system and method of the present invention. FIG. 3*b* illustrates the back side 33*b* of the exemplary mailpiece 33. FIG. 3*c* illustrates a letter 34 which is inserted inside the envelope prior to putting the envelope in the system 200. The mailpiece 33 of FIGS. 3*a–b* can be prepared, for example, by using an inserting system (not shown) to insert the letter 34 into an envelope. The system 200 of the present invention can then be used to address and sort the interoffice or internal mailing.

Figure 4A:
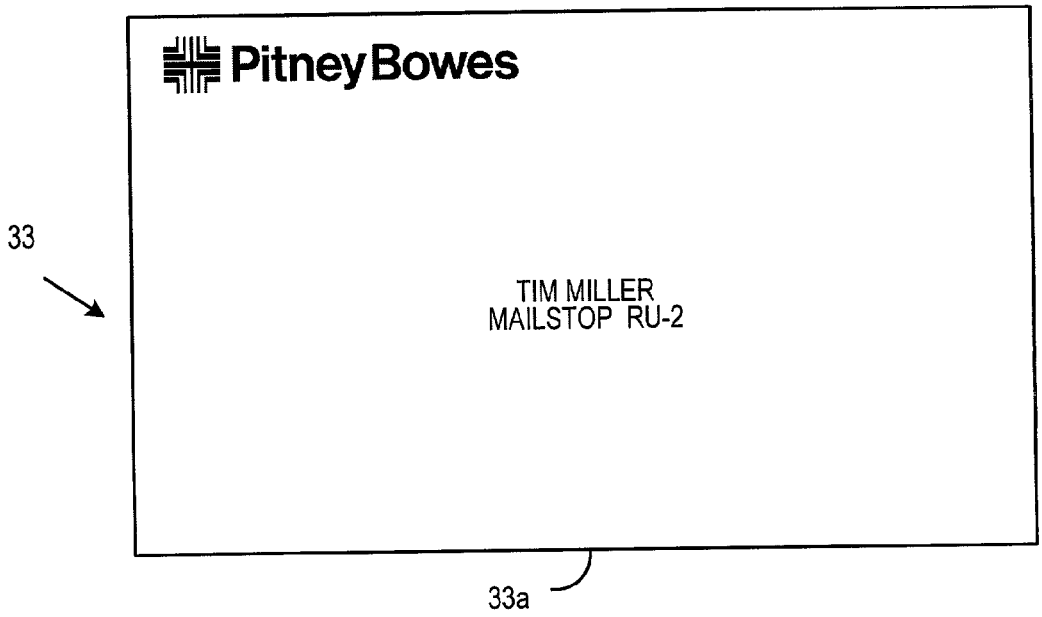
FIGS. 4*a–b* are front and back view of an exemplary mailpiece from internal mailing addressed and sorted by the system and method of the present invention.
Figure 4B:
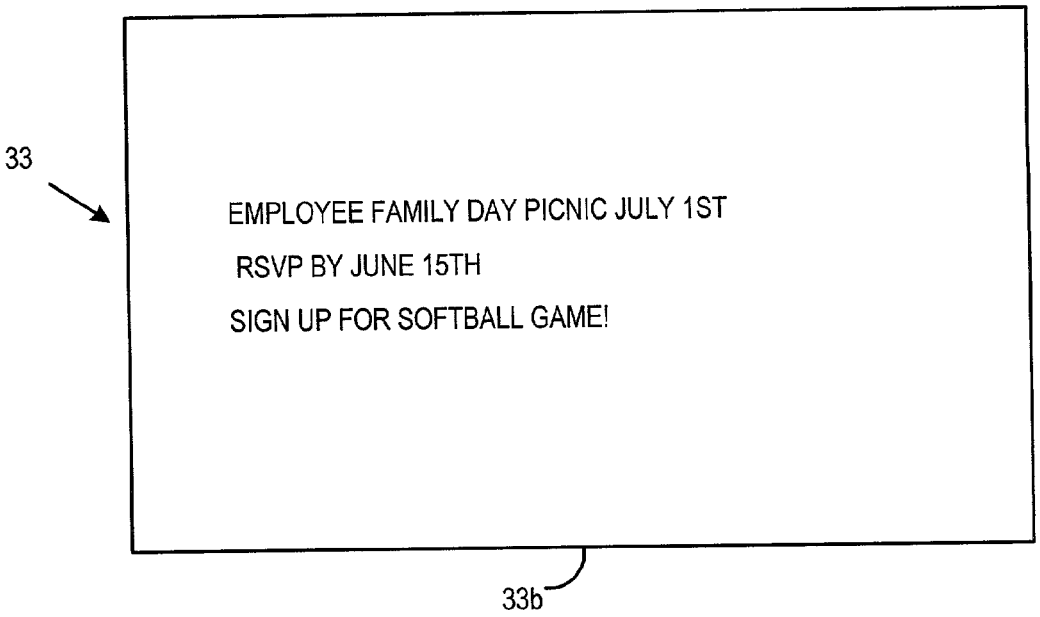

FIGS. 4*a–b* illustrate an exemplary interoffice mailpiece 33, which is a standard unfolded letter sized sheet of paper. FIG. 3*a* illustrates the front side 33*a* of the exemplary sheet mailpiece with employee address printed thereon. The employee address 29 is printed onto the mailpiece using the system and method of the present invention. FIG. 3*b* illustrates the information on the backside 33*b* of the mailpiece 33.

The feeder 10 of mailpiece sorting apparatus is designed to feed mailpieces of varying sizes, thicknesses and finishes and therefore, can singulate and feed variously configured internal mailings including, for example, single sheets and folded/tabbed sheets. The feeder's capability to handle such various mailpieces make it well suited for a purpose of the present invention, to singulate, address and sort internal mail distributions which are often of various sizes, thicknesses and finishes and are difficult to feed with a typical feeding apparatus. Exemplary aspects of the feeder 10 of the mailpiece sorting apparatus of the present invention are disclosed in the following: U.S. Pat. No. 5,971,391, issued Oct. 26, 1999 to Salomon et al. titled Nudger For A Mail Handling System; U.S. Pat. No. 6,003,857, issued Dec. 21, 1999 to Salomon et al. titled Singulating Apparatus For A Mail Handling System, U.S. Pat. No. 6,135,441 issued Oct. 24, 2000 to Belec et al. Titled Two Stage Document Singulating Apparatus For A Mail Handling System; U.S. Pat. No. 6,217,020 issued Apr. 17, 2001 to Supron et al. titled Method And Apparatus For Detecting Proper Mailpiece Position For Feeding; and U.S. Pat. No. 6,328,300 issued Dec. 11, 2001 to Stefan et al. titled Aligner Mechanism For A Mail Handling System and assigned to the assignee of the present invention and incorporated by reference herein.

Method of Preparing and Sorting an Internal Distribution

FIG. 5 is a flowchart of an embodiment of the method of the present invention illustrating steps of creating and sorting an employee mailing. At step S201 the method begins. At step S204 internal distribution (also called interoffice mail) mailpieces are put onto feeder 10 of mailpiece sorting apparatus 8. At step S206 a sort plan and distribution list are chosen. The sort plan is stored in database 22 and designates a delivery bin for each addressee in the sort plan. The internal distribution list is stored in database 23 and is used for obtaining internal addressee 29 information for printing on the mailpiece 33 (shown in FIGS. 4 and 5).

At step S208 the feeder 10 is set to auto feed. At step S210 the internal distribution mailpiece 33 is removed from the stack and moved along feedpath F. At step S212 the internal addressee information is obtained from database 23. At step S214, the internal addressee information is printed on mailpiece 33 using printer 13 of mailpiece sorting apparatus 8 (part of system 200). Next at step S216, the internal distribution addressee is compared with the sort plan to obtain a delivery bin designation. Next at step S218 a query is made as to whether the addressee is in the sort plan. If the answer to the query of step S218 is no, then at step S220*b* the mailpiece 33 is delivered to a reject bin 18*a*. If the answer to the query of step S218 is yes, then at step S220*a* the mailpiece is delivered to an appropriate sort bin 18 as designated by the sort plan. Following steps S220*a* and S220*v* a query is made at step S222 as to whether there are more mailpieces to be processed. If the answer to the query of step S222 is no, then at step S224, the method ends. If the answer to the query of step S222 is yes, then the method repeats steps S212 through S222 until there are no mailpieces left to be processed.

Figure 6:
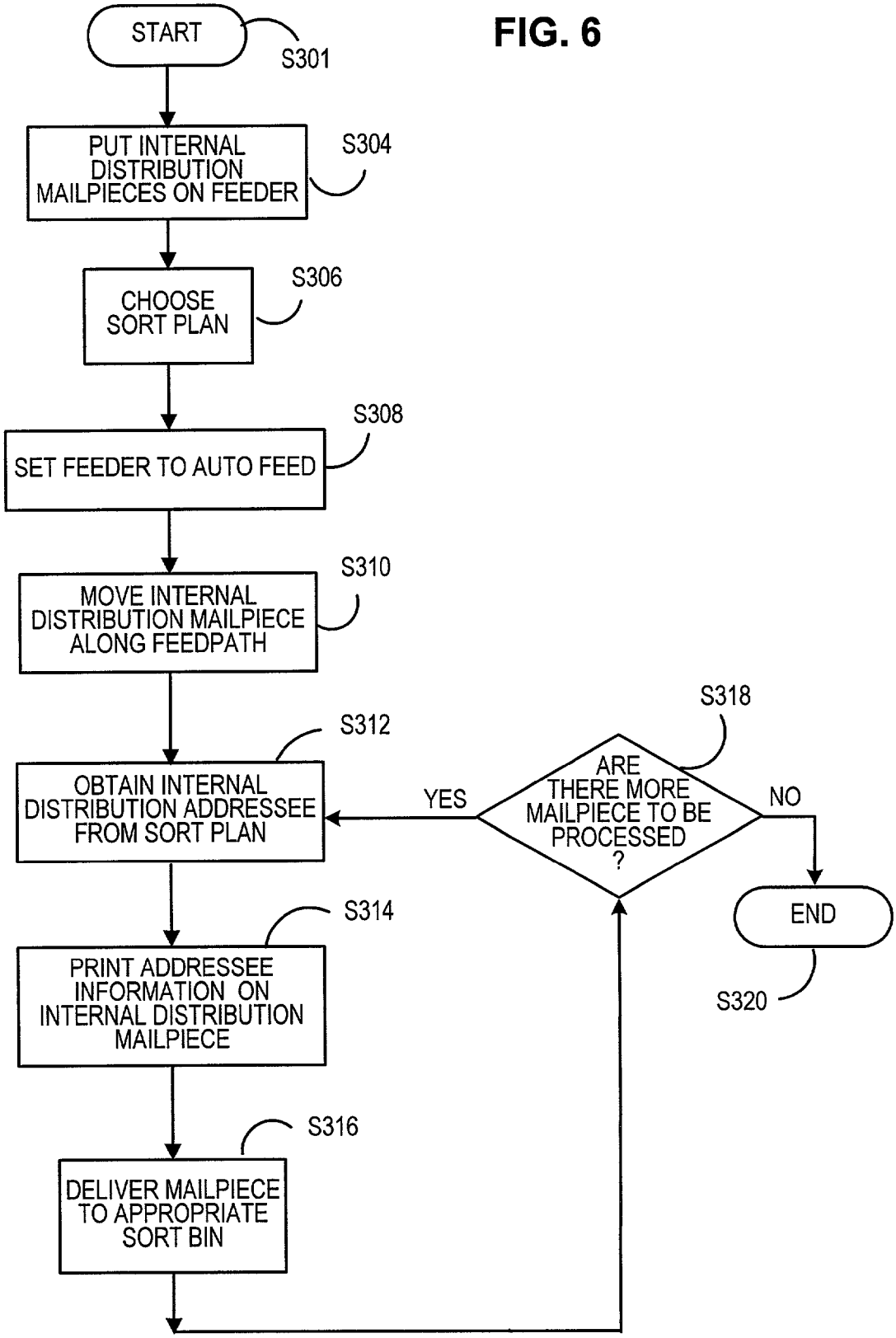
FIG. 6 is a flowchart of alternate embodiment of the method of the present invention illustrating steps of creating and sorting an employee mailing.

FIG. 6 is a flowchart of alternate embodiment of the method of the present invention illustrating steps of creating and sorting an employee mailing. The main difference between the embodiment of FIG. 5 and that of FIG. 6 is that the internal distribution is integrated into the sort plan so that no comparison of data (such as in step S216) is required. At step S301 the method begins. Next at step S304 the internal distribution mailpieces are placed on feeder 10 of mailpiece sorting apparatus 8. Next at step S306 a sort plan is chosen, the sort plan including the internal distribution list. At step S308 the feeder is set to auto feed. At step S310 the internal distribution mailpiece 33 is removed from the stack and moved along feedpath F. At step S312 the internal distribution addressee is obtained from the sort plan and at step S314 the addressee is printed on the mailpiece. The mailpiece 33 is then delivered to the appropriate sort bin 18 in accordance with the sort plan. Next at step S318 a query is made as to whether there are more mailpieces to be processed. If the answer to the query of step S318 is yes, then steps S312 through S318 are repeated until there are no mailpieces to be processed. If the answer to the query of step S318 is no, then the method ends at step S320.

The addressee database and sort plan of FIG. 6, used for preparing an internal mailing using an incoming mail sorting apparatus, is configured with a mailstop code or physical delivery point and a sort plan delivery point (designated bin). Each addressee in the sort plan has a physical mailstop (This field is configurable to correspond to the types of address information that a business might use for addressing interoffice mail i.e. floor or department, the use of mailstop in this example is for illustration purposes) and an assigned sort bin delivery point.

The present invention provides a simple method for preparing an internal mailing. Mailpieces can be addressed and sorted in one process. Thus, the method of the present invention provides a less costly, simplified way to prepare internal mailings. The system of the present invention permits personalization of communications, provides a process for creating internal mailings without applying labels, speeds distribution by using automated sorting and consolidates work on interoffice mailings. The system of the present invention also creates accurate internal mailings. Additional advantages and modifications will readily occur to those skilled in the art. Therefore, the invention in its broader aspects is not limited to the specific details and representative devices, shown and described herein. Accordingly, various modifications may be made without departing from the spirit or scope of the general inventive concept as defined by the appended claims.

What is claimed is:

1. A method of using an incoming mail sorting apparatus to sort employee mailings, method comprising the steps of:

a) printing employee address information on an unaddressed employee mailpiece using a printer situated along a feedpath of a mail sorting apparatus, the employee information obtained from at least one database of the mail sorting apparatus;

b) delivering the employee mailpiece to a destination bin designated by destination bin information stored in the at least one database of the mail sorting apparatus.

2. A method of using an incoming mail sorting apparatus to sort employee mailings, method comprising the steps of:

a) obtaining a group of unaddressed employee mailpieces;

b) placing unaddressed employee mailpieces on the incoming mail sorting apparatus;

c) singulating an unaddressed employee mailpiece from the group of employee mailpieces and feeding the employee mailpiece along a feedpath of the incoming mail sorting apparatus;

d) obtaining employee address information and destination bin information from at least one database of addressee information;

e) printing the employee information on the unaddressed employee mailpiece; and f) delivering the employee mailpiece to a destination bin designated by the destination bin information.

3. The method as claimed in claim 2 further comprising the step of:

g) repeating steps a) through f) until all employee mailpieces in the group of employee mailpieces have been delivered.

4. The method as claimed in claim 3 further comprising the step of:

h) generating a report indicating a number of employee mailpieces printed and delivered and a cost associated with printing and delivering the employee mailpieces from the group of employee mailpieces.

5. The method as claimed in claim 2 wherein in step e) the employee information includes employee name and delivery code information.

6. The method as claimed in claim 2 wherein in step e) the employee information includes a message to the employee.

7. The method as claimed in claim 2 wherein in step e) the employee information includes a clip art figure.

8. A method of using an incoming mail sorting apparatus to sort employee mailings, method comprising the steps of:

a) obtaining a group of unaddressed employee mailpieces;

b) placing unaddressed employee mailpieces on the incoming mail sorting apparatus;

c) singulating an unaddressed employee mailpiece from the group of employee mailpieces and feeding the employee mailpiece along a feedpath of the incoming mail sorting apparatus;

d) obtaining employee address information and destination bin information from at least one database of addressee information; and e) printing the employee address information on the unaddressed employee mailpiece;

f) delivering the employee mailpiece to a destination bin designated by the destination bin information;

g) repeating steps a) through f) until all employee mailpieces in the group of employee mailpieces have been delivered; and h) generating a report indicating a number of employee mailpieces printed and delivered and a cost associated with printing and delivering the employee mailpieces from the group of employee mailpieces.

9. The method as claimed in claim 8 wherein in step e) the employee information includes employee name and delivery code information.

10. The method as claimed in claim 8 wherein in step e) the employee information includes a message to the employee.

11. The method as claimed in claim 8 wherein in step e) the employee information includes a clip art figure.

* * * * *

UNITED STATES PATENT AND TRADEMARK OFFICE

CERTIFICATE OF CORRECTION

PATENT NO. : 6,988,021 B2
DATED : January 17, 2006
INVENTOR(S) : Edward P. Daniels et al.

It is certified that error appears in the above-identified patent and that said Letters Patent is hereby corrected as shown below:

Title page,
Item [75], Inventors, add -- Robert K. Gottlieb, Milford, CT (US) and James Giordano, Danbury, CT (US) --.

Signed and Sealed this

Thirtieth Day of May, 2006

JON W. DUDAS
*Director of the United States Patent and Trademark Office*